US006640869B2

(12) United States Patent
Ralph et al.

(10) Patent No.: US 6,640,869 B2
(45) Date of Patent: Nov. 4, 2003

(54) STORM DOOR WITH COUNTERBALANCE

(75) Inventors: James L. Ralph, Shoreview, MN (US); Todd N. Stratmoen, Mahtomedi, MN (US); David M. Wamre, Clear Lake, IA (US)

(73) Assignee: Pella Corp., Pella, IA (US)

( * ) Notice: Subject to any disclaimer, the term of this patent is extended or adjusted under 35 U.S.C. 154(b) by 0 days.

(21) Appl. No.: 10/026,669

(22) Filed: Dec. 21, 2001

(65) Prior Publication Data

US 2003/0121618 A1 Jul. 3, 2003

(51) Int. Cl.[7] ..... E05D 15/22

(52) U.S. Cl. ..... 160/90; 49/164; 49/94

(58) Field of Search ..... 49/445, 447, 448, 49/429, 430, 432, 164, 194, 163, 166, 168; 160/90, 101

(56) References Cited

U.S. PATENT DOCUMENTS

| | | | | |
|---|---|---|---|---|
| 1,262,175 | A | * | 4/1918 | Clark |
| 2,116,781 | A | * | 5/1938 | Delich |
| 3,145,433 | A | * | 8/1964 | Jones |
| 3,375,610 | A | * | 4/1968 | Beasley, Jr. et al. |
| 4,028,849 | A | * | 6/1977 | Anderson |
| 5,274,955 | A | * | 1/1994 | Dallaire et al. |
| 5,803,145 | A | * | 9/1998 | Lamb ..... 160/90 |
| 6,041,550 | A | * | 3/2000 | Tix |
| 6,055,782 | A | * | 5/2000 | Morton et al. |
| 6,256,931 | B1 | * | 7/2001 | Kenkel et al. |

* cited by examiner

*Primary Examiner*—Blair M. Johnson
(74) *Attorney, Agent, or Firm*—Faegre & Benson, LLP

(57) ABSTRACT

A storm door (20) ventilation through a screen (50) by either or both of slidable sashes (92, 93). The storm door may also utilize a flexible member (80) to secure a liner (30, 40, 53, 54) to a side, without the use of mechanical fasteners. Sash weight balancing assemblies are utilized in a three track door.

26 Claims, 8 Drawing Sheets

STORM DOOR WITH COUNTERBALANCE

BACKGROUND OF THE INVENTION

1. Field of the Invention

This invention relates generally to a storm door, and more particularly to a storm door with a sash weight balancing assembly and also to a storm door having an improved method of assembly.

2. Description of the Prior Art

Storm doors and windows have been used for many years for providing reduced transmission of thermal energy through doors and windows. Storm doors may be readily removable or be provided with a window sash that may be replaced with a screen to provide ventilation. Other storm doors have operable sashes that are often limited to certain preset positions and also the full weight of the sash must be lifted in order to move the sash.

U.S. Pat. No. 5,803,145 does describe a storm door assembly that utilizes a counterbalance. However, this storm door has only one sash that is operable. Another windowpane is positioned on top of a screen assembly. It is therefore possible to only ventilate either the top or the bottom, depending upon how the door is constructed.

The present invention addresses the problems associated with the prior art and provides for a storm door which has sash weight balancing assemblies for two operable sashes that are positioned adjacent to a screen. The screen and sashes allow for the storm door to be ventilated at either the top or bottom or both. Further, the present invention provides for a storm door which utilizes a unique and improved assembly.

SUMMARY OF THE INVENTION

In one embodiment, the invention is a storm door that has a frame. The frame has first and second sides, a top extending between and interconnecting the sides at their upper ends and a bottom extending between and interconnecting the sides at their lower ends. A first jamb liner is operatively connected to the first side and forms a vertically extending first hollow chamber between the first side and the first jamb liner. A second jamb liner is operatively connected to the second side and forms a vertically extending hollow chamber between the second side and the second jamb liner, the jamb liners form first, second and third positions relative to the door's exterior to interior orientation. A screen is positioned between the first positions. A first slidable window sash is positioned between the jamb liners at the second positions and the second slidable window sash is positioned between the jamb liners at the third positions. First and second sash weight balancing assemblies are connected to the first and second sides, respectively, and each are connected to the first slidable window sash. The first and second sash weight balancing assemblies are located in the first and second hollow chambers, respectively, for counterbalancing the first slidable sash. Third and fourth sash weight balancing assemblies are connected to the first and second sides, respectively, and each are connected to the second slidable window sash. The third and fourth sash weight balancing assemblies are located in the first and second hollow chambers for counterbalancing the second slidable sash.

In another embodiment, the invention is a storm door having a frame. The frame has first and second sides. The sides are operatively connected at their top ends by a top and at their bottom ends by a bottom. The sides have first and second side end members operatively connected to a side connecting member, thereby forming sides having openings. First and second jamb liners have first and second jamb liner end members operatively connected to a jamb liner connecting member. The first and second jamb liners are positioned in the opening of the first and second sides, respectively, forming hollow chambers between the sides and liners. The first jamb liner end members are positioned on the side first end members and the second jamb liner end members are positioned proximate the side connecting members. A first flexible member is forced between the jamb liner connecting members and the sides, whereby the jamb liners are firmly held in place by the first flexible members.

In another embodiment, the invention is a storm door having a frame. The frame has first and second sides. The sides are operatively connected at their top ends by a top and their bottom ends by a bottom. The sides have a wall to form an opening. First and second jamb liners are positioned in the openings of the first and second sides, respectively, to form hollow chambers between the sides and liners. The wall jamb liners have at least two points of contact with the sides to limit movement of the liners. Flexible members are forced between the sides and liners whereby the jamb liners are firmly held in place by the flexible member.

DETAILED DESCRIPTION OF THE PREFERRED EMBODIMENT

Figure 1:
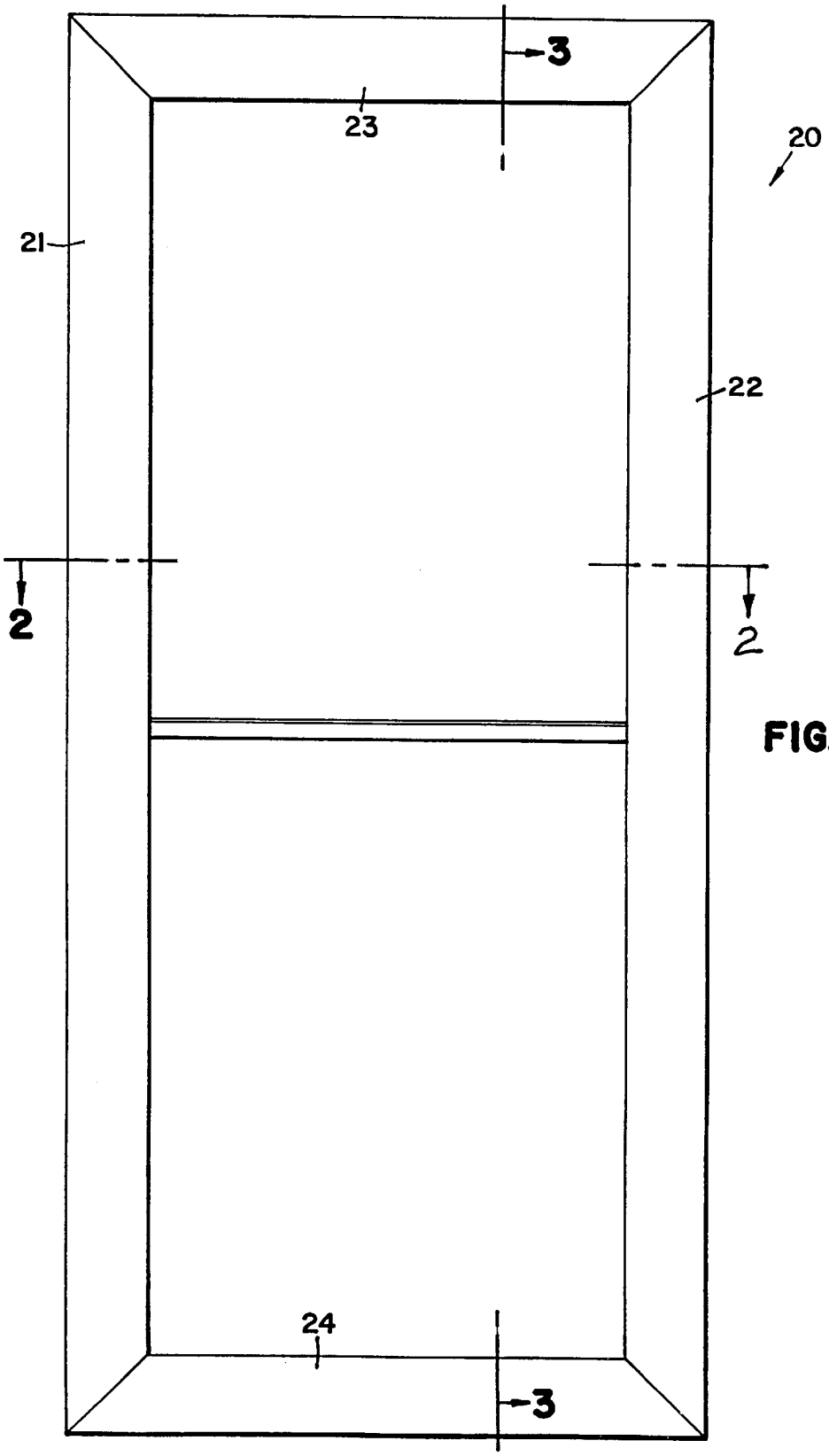
FIG. 1 is a perspective view of the storm door of the present invention.

Referring to the drawings, wherein like numerals represent like parts throughout the several views, there is generally designated at 20 a storm door. The storm door 20 includes a frame that has a first side rail 21 operatively connected to a second side rail 22 by a top (head) rail 23 and bottom (sill) rail 24. The rails 21–24 are connected by means, well known in the art, such as corner keys. The rails 21–24 utilize the same profile and are mitered at their ends. The use of the same extrusion profile for all four of the rails provides for a door assembly process which utilizes fewer components, and is therefore more efficient.

Figure 2:
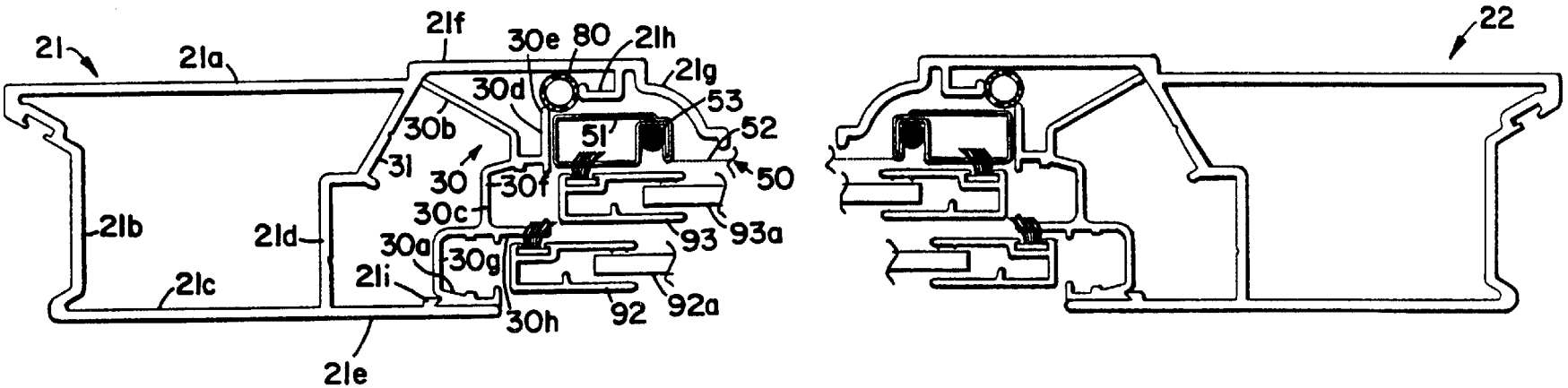
FIG. 2 is a cross-sectional view taken generally along the lines 2—2 of FIG. 1.
Figure 4:
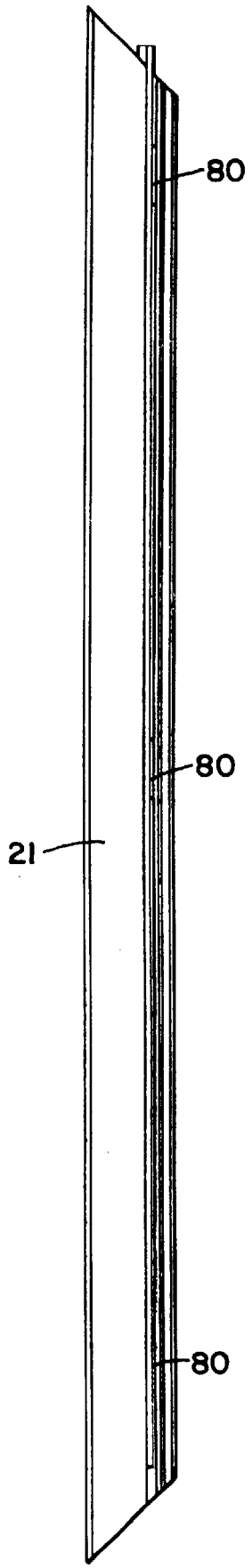
FIG. 4 is a front plan view of an assembled side rail and liner.

Only one of the rails will be described in detail as it is understood that all four of the profiles for the four rails are identical. Referring now to FIGS. 2 and 4, the side rail 21 includes a top section 21 a connected to a side section 21*b*, connected to a bottom section 21*c*, which is in turn connected to a side section 21*d*, which is connected to the top section 21*a*. It is understood that the descriptive words "top", "side" and "bottom" are arbitrary and depending upon the rail 21–24 that is being described could refer to a different orientation. The descriptive terms are used only to assist to describe the profile of the side rail 21 and would have different orientations for the other rails. The rails 21–24 are preferably an aluminum extrusion and is therefore formed as an integral one-piece rail. The four sections 21*a*–21*d* form a generally standard hollow opening to receive a gusset. A first end member 21*e* extends outward from the side section 21*d* and is in general alignment with the bottom section 21*c*. A second end member 21*f* extends outward from the top section 21*a* and is generally parallel to the first end member 21*e*. The side section 21*d* also forms a connecting member between the first end member 21*e* and second end member 21*f*. A generally curved cover member 21*g* is connected to the second end member 21*f*. A stop leg 21*h* extends generally downward from the second end member 21*h* and is laterally spaced from a liner, to be described in more detail hereafter. A protrusion 21*i* extends from the first end member 21*e* and extends generally toward the second end member 21*f*.

A first jamb liner 30 is operatively connected to the first side rail 21, as will be discussed more fully hereafter, and forms a first hollow chamber 31 which vertically extends between the first side rail 21 and the first jamb liner 30. Similarly, a second jamb liner 40 is operatively connected to the second side rail 22 and forms a second hollow chamber 41 which vertically extends between the second side rail 22 and the second jamb liner 40. The jamb liners 30, 40 are identical and are mirror images of each other. Therefore, only the first jamb liner 30 will be described in detail, it being understood that the second jamb liner 40 is a mirror image thereof. The jamb liner 30 includes a first jamb liner end member 30a operatively connected to a second jamb liner end member 30*b* by a jamb liner connecting member 30*c*. An extension member 30*d* is operatively connected to the jamb liner connecting member 30*c*. The extension member 30*d* is generally planar and forms a surface for positioning the screen, as will be described more fully hereafter. The extension member 30*d* also has an end 30*e*. The end 30*e* is laterally spaced from the stop leg 21*h*. A screen 50 includes a frame 51 to which a screen material 52 is secured by suitable means such as a spline 53. The spline would be positioned in the open U-shaped channel formed by the frame 51. The screen 50 extends from the top liner 53 to the bottom liner 54 so that the screen is behind both of the slidable window sashes, as will be described more fully hereafter. The liner 30 includes a member 30*h* that extends away from the jamb liner connecting member 30*c*. The member 30*h*, along with the jamb liner connecting member 30*c* forms a third generally U-shaped track 30*f*. The jamb liner 30 also forms a second generally U-shaped track 30*g* with the first jamb liner end member 30*a* and the jamb liner connecting member 30*c*. The liner therefore provides for what is known as a three track construction. The third and second tracks are the tracks 30*f*, 30*g*. The first "track" is formed by the planar surface of the extension member 30*d* and provides for a "track" in which the screen 50 is positioned.

Figure 3:
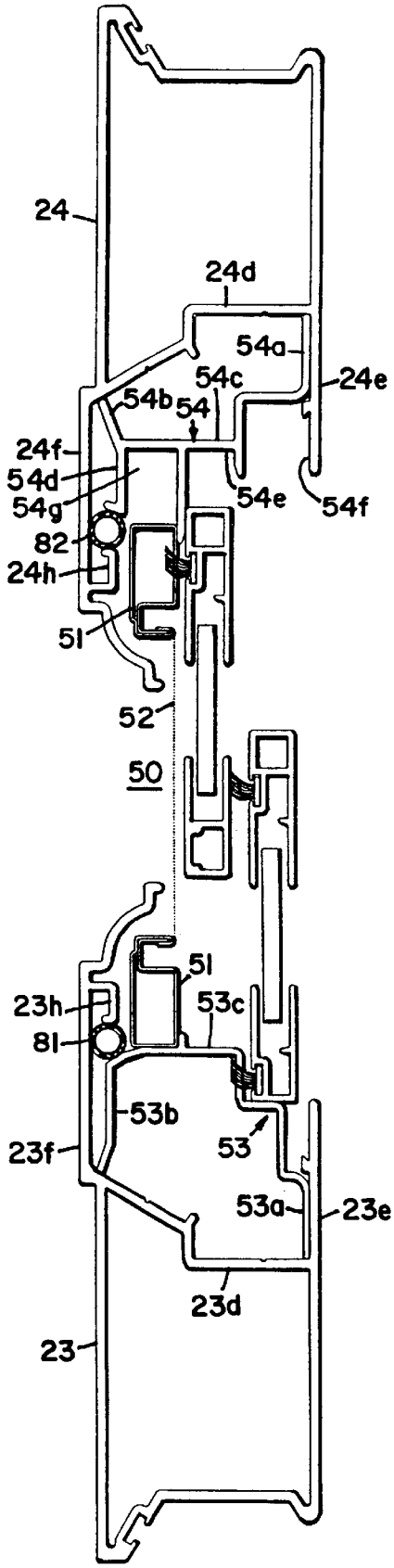
FIG. 3 is a cross-sectional view taken generally along the lines 3—3 of FIG. 1.

Referring now to FIG. 3, there is shown the third (sill) liner 53, which is the bottom liner. The bottom liner 53 includes a first end member 53*a* operatively connected to a second end member 53*b* by a sill connecting member 53*c*. The fourth (head) liner 54 includes a first end member 54*a* operatively connected to a second end member 54*b* by a head connecting member 54*c*. A head extension member 54*d* extends outward from the head connection member 54*c* and is laterally positioned from the stop 24*h* of the bottom rail 24. The top liner 54 forms a second U-shaped track 54*e*. A third track 54*f* is formed by the top liner 54 and the first end member 24*e* of rail 24. A first track 54*g* is formed for the screen 50.

The liners 30, 40, 53 and 54 are formed from a suitable material such as extruded aluminum.

Figure 5:
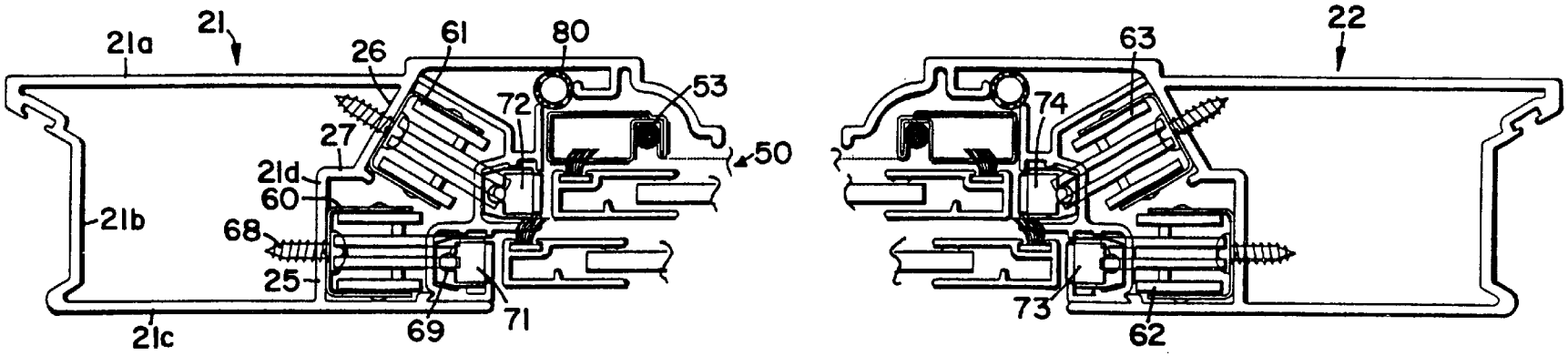
FIG. 5 is a cross-sectional view, similar to FIG. 2, with the addition of the sash weight balancing assemblies.
Figure 6:
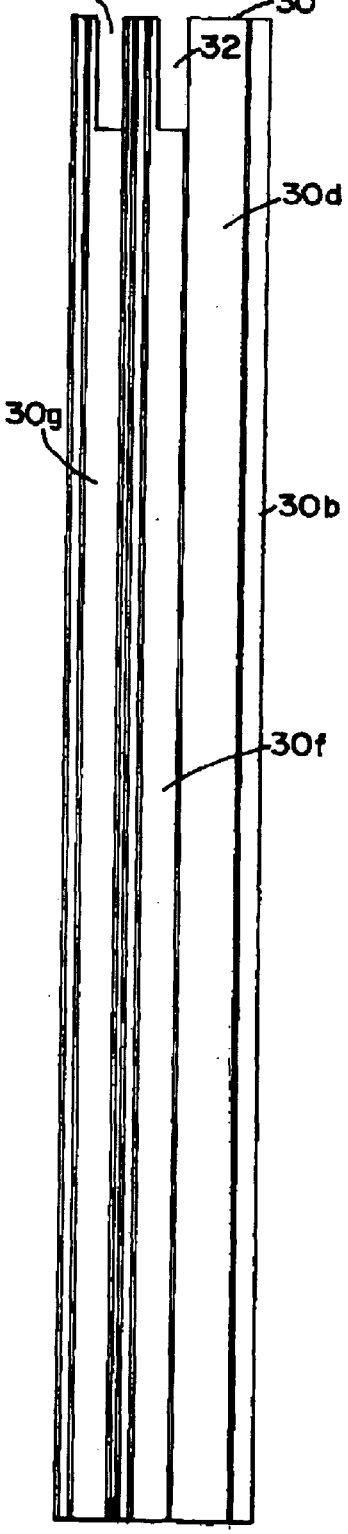
FIG. 6 is a front elevational view of a side liner.
Figure 7:
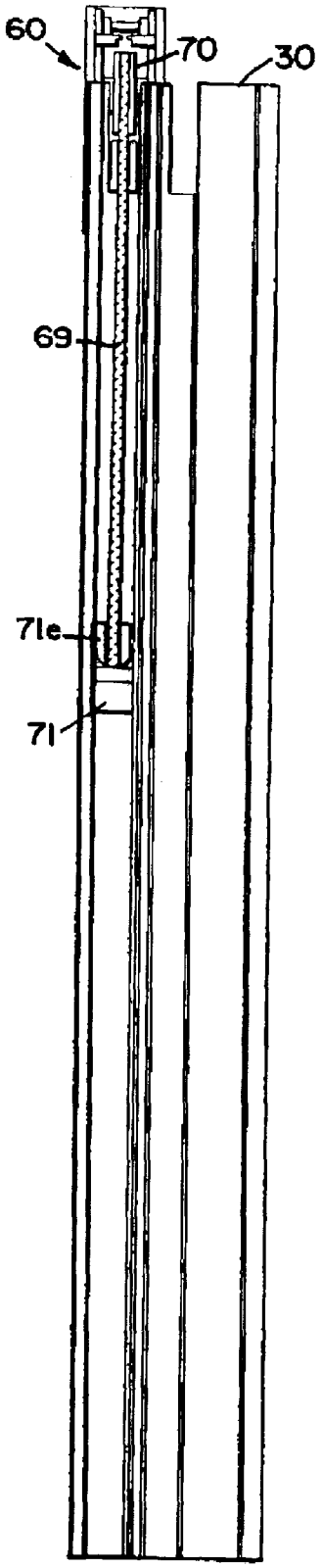
FIG. 7 is a side elevational view of a side liner with a sash weight balancing assembly in position.
Figure 8:
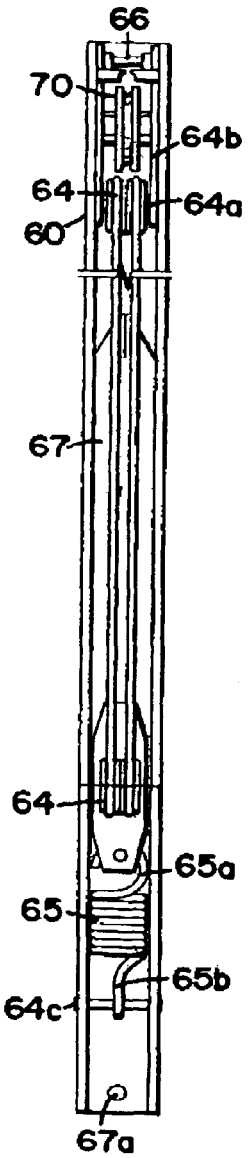
FIG. 8 is an elevational view of a sash weight balancing assembly without the liner.

Referring now to FIGS. 5–8, a first sash weight balancing assembly 60 and a second sash weight balancing assembly 61 are shown. Sash weight balancing assemblies 60, 61 are positioned in the hollow chamber 31. Third and fourth sash weight balancing assemblies 62, 63 are positioned in the hollow chamber 41. The sash weight balancing assemblies 60–63 are identical. Further, sash weight balancing assemblies 62, 63 (and their shoes 73, 74) are mounted in a similar manner to sash weight balancing assembly 60, 61. Therefore, only the details of one sash weight balancing assembly 60 and the securing of sash weight balancing assemblies 60, 61 will be described in detail. The sash weight balancing assemblies 60–63 are known in the art and are assemblies such as block and tackle balances available from BSI of Sioux Falls, S.Dak. Other suitable balances may also be used. In FIG. 6, the liner 30 is shown in a front elevational view. Two notches 32, 33 are formed at the top of the liner 30 that are not seen as viewed in the cross section in FIG. 2. Then, in FIG. 7, a sash weight balancing assembly 60 is shown in position behind the liner 30. The rail 21 is not shown. FIG. 8 shows just the sash weight balancing assembly 60, which is well known in the art. The sash weight balancing assembly 60 includes a block and tackle assembly 64, channel 67 and spring 65. The block and tackle assembly 64 is operatively connected to a channel 67 which is the main support structure of the sash weight balancing assembly 60. A pin 66 is mounted between the sides of the channel 67 and extends through a bracket 64*b*. A pin 64*a* is also connected between the bracket 64*b* and is used to mount one end of the block and tackle 64. The other end of the block and tackle 64 is connected to a spring 65. The spring 65 has a first end 65*a* that is connected to the block and tackle through a hole (not shown) in the block and tackle 64. The second end 65*b* of the spring 65 is connected to a pin 64*c*. The pin 64*c* is operatively connected to the side walls of the channel 67. The only connection mounting the sash weight balance assembly 60 to the rail is a screw 68 through a hole 67*a*. The block and tackle assembly 64 is connected by a rope 69 (shown only in FIG. 7) that is positioned over pulley 70. The rope 69 is not shown in FIG. 8. The second end of the rope 69 is connected to a slidable shoe 71. The shoe 71 is sized and configured to ride in the second track 30*g*. For clarity sake, the second sash weight balancing assembly 61 is not shown in FIGS. 6–8. However, as can be seen in FIG. 5, the second sash weight balancing assembly 61 is similarly mounted to the rail 21. The sash weight balancing assemblies 60, 61 are connected to the side section 21*d* of the first rail 21. The side section 21*d* has a first segment 25 and a second segment 26. Screw 68 secures the sash weight balancing assembly 60 to the first segment 25 and screw 68 secures the second sash weight balancing assembly 61 to the second segment 26. The second segment 26 is at an angle of approximately 30 degrees from the vertical, as shown in FIG. 5, whereas the first segment 25 is vertical. This angle of 30 degrees along with the offset by third segment 27 allows the rope of the sash weight balancing assembly 61 to be positioned so that the slidable sashes may be closer together. It can be seen that if the sash weight balancing assembly was fastened on the side rail 21 parallel to the first sash weight balancing assembly 60, the slidable sashes would have to be further apart thereby creating a thicker door. The rope 69 of the sash weight balancing assembly 61 is connected to a second shoe 72 which is sized and configured to slide in the first U-shaped channel 30*f*. The shoes 71, 72 are designed to be operatively connected to the slidable sashes, as will be described more fully hereafter.

The liners 30, 40 are operatively connected to the rails 21, 22, respectively, without the use of mechanical fasteners. Instead, a flexible member 80 is used. The liner 40 is operatively connected to the rail 22 in the same manner that the liner 30 is connected to the rail 21. Therefore, only the connection of the liner 30 to the rail 21 will be discussed in detail. Referring to FIGS. 2 and 4, the liner 30 is positioned in the opening formed between the first end member 21*e* and second end member 21*f*. The liner 21 is positioned such that the first jamb liner end member 30*a* is positioned against the first end member 21*e* and the protrusion 21*i*. The second member 30*b* is positioned proximate the side section 21*d*. Each end member 21*e*, 21*f* is limited in movement with respect to the adjacent member of the side rail 21. Then, a flexible member 80, such as a segment of a round tube, is positioned between the extension member 30*d* and the stop leg 21*h*. This fixes the liner 30 in position so that no movement in any direction is allowed. A plurality of flexible members 80 may be used as shown in FIG. 4. Each flexible member is approximately 2–3 inches long. It has been found that it is not necessary to use a long continuous strip and therefore the discrete segments make for an easier and less costly assembly. It can therefore be seen that the liners are secured in position with respect to the rails 21, 22 without the use of mechanical fasteners. The flexible member 80 is of a suitably soft durometer, such as 75 Shore A, to allow it to be compressed. One embodiment that has been found useful is a tube that is ¼ inch in diameter and has wall thicknesses of 1/16 inch. The exact size and thickness would depend upon the distance between the stop leg 21*h* and the end 30*e*. It needs to be thin enough to be positioned between the two and at the same time, thick enough to provide for an interference fit after it has been squeezed between the lateral stop 21*h* and the end 30*e*. Further, it is recognized that the flexible member 80 is shown as a circle in the drawings, wherein after assembly it would typically be flattened somewhat. Also, the flexible member would not have to be hollow, but compressible enough to be inserted to form an interference fit.

Now referring to FIG. 3, it is shown how the liners 53, 54 are similarly secured to the rails 23, 24 by use of flexible members 81, 82. The liner 53 is positioned in the opening between the end members 23*e*, 23*f*. The first end member 53*a* is positioned on the first end member 23*e* and also against the side section 23*d*. The second end member 53*b* is positioned also against the side member 23*d* thereby limiting the movement of the liner 53 in two directions. The flexible member 81 is then squeezed between the lateral stop leg 23*h* and the sill connecting member 53*c* to secure the liner 53 in position without mechanical fasteners. Similarly, the liner 54 is placed in the opening between the ends 24*e* and 24*f* of the rail 24. The first end member 24*a* is positioned against the first end member 24*e* and the second end member 54*b* is positioned against the side section 24*d* of the rail 24. This again limits the movement of the liner 54 in at least two directions. Then, the flexible member 82 is forced between the stop leg 24*h* and the extension member 54*d* thereby securing the liner 54 in position without use of mechanical fasteners. The flexible members 81, 82 are similar to that previously described with respect to flexible member 80.

While the frame has been described as comprising four rails operatively connected, it is understood that the frame could be constructed in such a manner as to have the rails integral with each other through either a single or multiple layer construction. That is, the frame has two sides, top and bottom and any suitable construction, well known in the art, may be utilized.

While the liners have been described as separate from the rails and then operatively connected, it is understood that the liners and rails could be operatively connected by the liners being made integral with the rails. In such a case, the door would have a frame that would comprise four sides, the sides being a combination of a liner and a rail.

Figure 9:
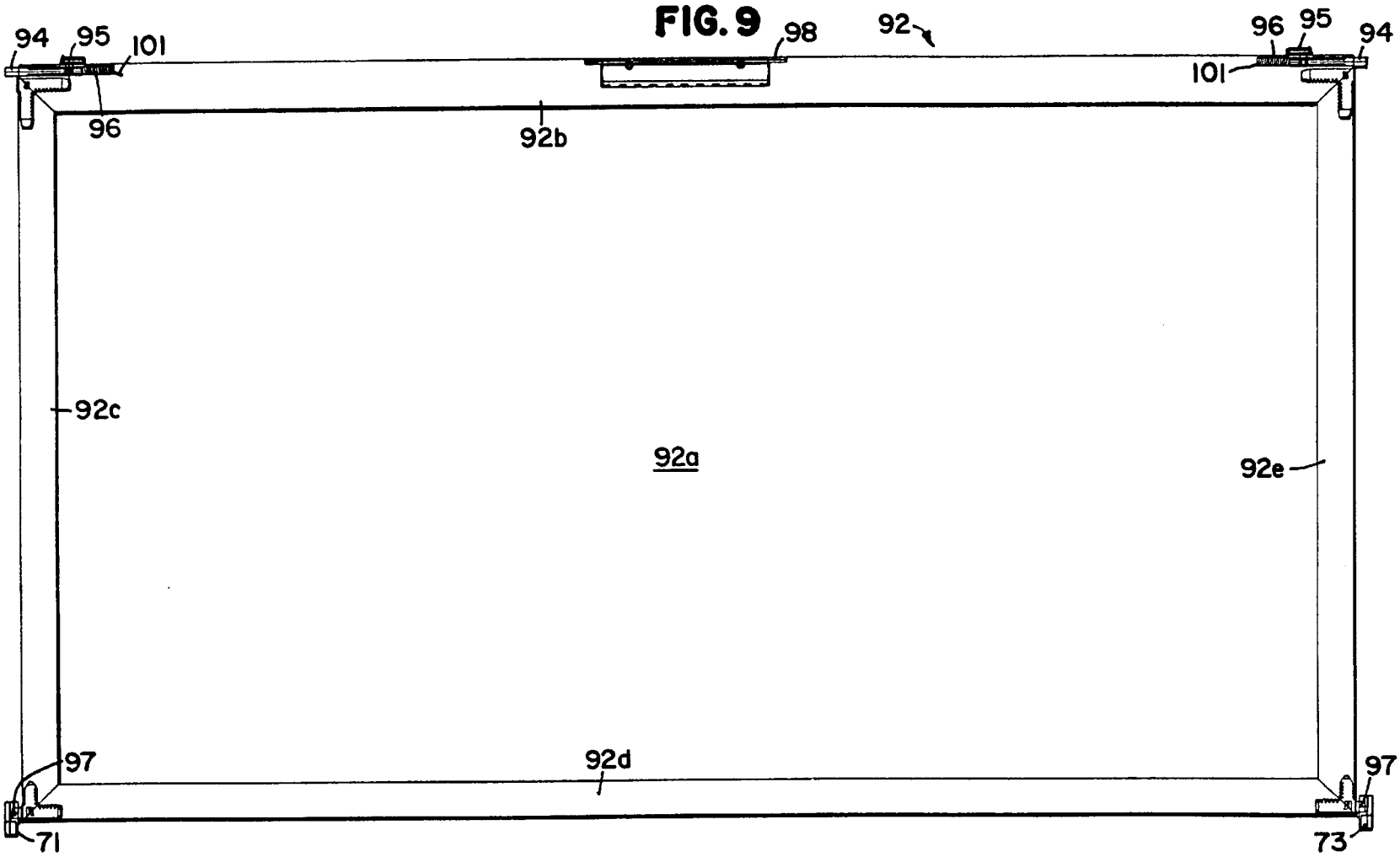
FIG. 9 is a front plan view of the lower slidable sash.
Figure 10:
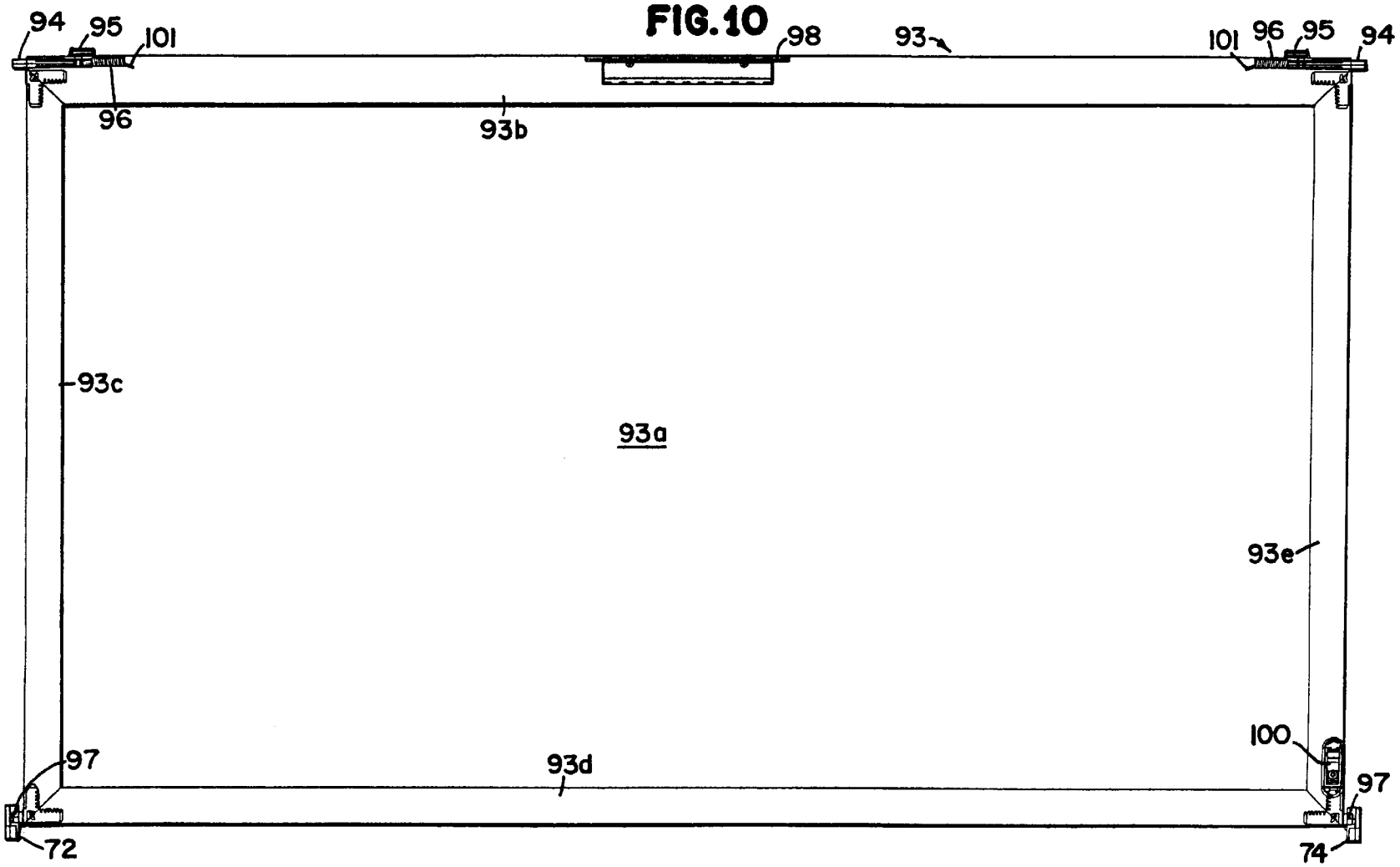
FIG. 10 is a front plan view of the upper slidable sash.

Referring to FIG. 9, there is disclosed a slidable sash. The slidable sash shown is the lower or bottom sash 92 which is operatively connected to the first shoe 71. The upper sash 93 is similar and is operatively connected to the second shoe 72. The sash 92 includes a glass pane 92*a* suitably mounted between four sides 92*b*–92*e*. Such construction is well known in the art. Four corner keys are shown, but would be hidden by the sides. Two spring-mounted posts 94 are attached to the top of the sash 92. The posts 94 are movable in and out by a lever 95. The lever 95 operatively connected to the post 94. The spring 96 biases the posts 94 in the outward direction. A stop 101 is formed by bending up a part of the side 92*b*. This provides a stop on which the spring 96 may be positioned to bias the post 94 outward. The posts 94 slide in the track 30*g*. Fixed lower posts 97 are suitably secured to the lower portion of the sash 92 by means well known in the art. The lower posts 97 are sized and configured to fit within a slot in shoe 72. The slot of shoe 72 is not shown, but is the same as the slot 71*e* shown in FIG. 7 of the shoe 71. By the posts 97*b* being supported by and captured in the slot of the shoe 72, the balancing force of the sash weight balancing assembly 60 is transferred to the sash 92 thereby aiding in the raising and lowering of the sash as well as allowing the sash to be positioned in any position and held in place by the sash weight balancing assembly. It is understood that the spring mounted posts could be at the bottom of the sash and the fixed (sash weight balance engaging) posts located at the top of the sash. A handle 98 is secured to the sash 92 to raise and lower the sash 92.

The upper sash 93 is of similar construction to the lower sash 92 and will not be described in detail. It is of course understood that the width is slightly different than the lower sash 92 as there is a difference between the width between the track for the upper sash 93 and the lower sash 92. The other difference between the upper sash 93 and the lower sash 92 is the inclusion of a spring loaded latch. The latch is spring loaded and therefore, when the sashes are in the closed position, prevents the raising of the sash 92 or lowering of the sash 93 without the depression of the latch 100. The depression of the latch 100 can of course only be accomplished from the inside of the building, thereby preventing someone from the outside activating the latch 100 to allow the sashes 92, 93 to move.

The liners 20, 30 effectively hide the balances, are easily removable/replaceable, and create tracks for the sashes to slide. The three "track" construction allows for ventilation from either the top or bottom and provides for a counterbalance for both the upper and lower sash.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A storm door comprising:

a) a frame having first and second sides, a top extending between and interconnecting the sides at their upper ends and a bottom extending between and interconnecting the sides at their lower ends;

b) a first jamb liner operatively connected to the first side and forming a vertically extending first hollow chamber between the first side and the first jamb liner;

c) a second jamb liner operatively connected to the second side and forming a vertically extending second hollow chamber between the second side and the second jamb liner;

d) the jamb liners forming first, second and third positions;

e) a screen positioned between the first positions;

f) a first slidable window sash positioned between the jamb liners at the second positions;

g) a second slidable window sash positioned between the jamb liners at the third positions;

h) first and second sash weight balancing assemblies connected to the first and second sides respectively and each connected to the first slidable window sash, said first and second sash weight balancing assemblies located in the first and second hollow chambers respectively, for counterbalancing the first slidable sash;

i) third and fourth sash weight balancing assemblies connected to the first and second sides respectively and each connected to the second slidable window sash, the third and fourth sash weight balancing assembly located in the first and second hollow chambers for counterbalancing the second slidable sash; and j) first and second flexible members compressibly retained between the first and second jamb liners and the first and second sides, respectively, so as to secure the first and second flexible members with an interference fit, whereby the first and second jamb liners are firmly held in place by the first and second flexible members, respectively.

2. The storm door of claim 1, wherein the first side is a first side rail, the second side is a second side rail, the top is a top rail and the bottom is a bottom rail.

3. The storm door of claim 1, wherein the screen is adjacent both first and second sashes when the sashes are in a closed position.

4. The storm door of claim 1, wherein the third and fourth sash weight balancing assemblies are at an angle to the first and second sash weight balancing assemblies, thereby allowing for a narrower door.

5. The storm door of claim 1, wherein the jamb liners are aluminum.

6. A storm door comprising:

a) a frame having first and second sides, said sides operatively connected at their top ends by a top and at their bottom ends by a bottom;

b) said sides having first and second side end members operatively connected to a side connecting member, thereby forming sides having openings;

c) first and second jamb liners having first and second jamb liner end members operatively connected to a jamb liner connecting member;

d) said first and second jamb liners positioned in the openings of the first and second sides respectively, forming hollow chambers between the sides and jamb liners;

e) said first jamb liner end members positioned on the side first end members and the second jamb liner end members positioned proximate the side connecting members; and f) first flexible members compressibly retained between the jamb liners and the sides so as to secure the first flexible members with an interference fit, whereby the jamb liners are firmly held in place by the first flexible members.

7. The storm door of claim 6, wherein the first side is a first side rail, the second side a second side rail, the top a top rail, the bottom a bottom rail, the first side end member a first side end rail member, the second side end member a second side end rail member.

8. The storm door of claim 7, the side rails second end members having first stop members extending from the side rail second end members, the first stop members laterally spaced from the jamb liners when assembled, wherein the first flexible members are positioned between the first stop members and the jamb liners.

9. The storm door of claim 8, further comprising an extension member operatively connected to the jamb liner, the extension member positioned proximate the stop, wherein the flexible member is retained between the extension and the stop.

10. The storm door of claim 6, further comprising:

a) the top having first and second top end members operatively connected to a top side member, forming a top having an opening;

b) a top liner having first and second top end members operatively connected to a top side member;

c) said top liner positioned in the opening of the top opening;

d) said top liner first end member positioned on the top first end member and the top liner second end member positioned proximate the top connecting member; and e) a second flexible member compressibly retained between the top liner and the top with an interference fit, whereby the top liner is firmly held in place by the second flexible member.

11. The storm door of claim 10, the top second end member having a second stop member extending from the top second end member, the second stop member laterally spaced from the top liner when assembled, wherein the second flexible member is positioned between the second stop member and the top liner.

12. The storm door of claim 10, further comprising:

a) the bottom having first and second bottom end members operatively connected to a bottom side member, forming a bottom having an opening;

b) a bottom liner having first and second bottom end members operatively connected to a bottom side member;

c) said bottom liner positioned in the opening of the bottom opening;

d) said bottom liner first end member positioned on the bottom first end member and the bottom liner second end member positioned proximate the bottom connecting member; and e) a third flexible member compressibly retained between the bottom liner and the bottom with an interference fit, whereby the bottom liner is firmly held in place by the third flexible member.

13. The storm door of claim 12, the bottom second end member having a third stop member extending from the bottom third end member, the third stop member laterally spaced from the bottom liner when assembled, wherein the third flexible member is positioned between the third stop member and the bottom liner.

14. The storm door of claim 6, further comprising:

a) the jamb liners forming first, second and third positions;

b) a screen extending between the first position;

c) a first slidable window sash positioned between the jamb liners at the second position; and d) a second slidable window sash positioned between the jamb liners at the third position.

15. The storm door of claim 14, further comprising:

a) first and second sash weight balancing assemblies connected to the first and second sides respectively and each connected to the first slidable window sash, said first and second sash weight balancing assemblies located in the first and second hollow chambers respectively, for counterbalancing the first slidable sash; and b) third and fourth sash weight balancing assemblies connected to the first and second sides respectively and each connected to the second slidable window sash, the third and fourth sash weight balancing assemblies located in the first and second hollow chambers for counterbalancing the second slidable sash.

16. The storm door of claim 6, wherein the first flexible members comprise a plurality of discrete flexible segments spaced apart along a length of the sides between the top and the bottom.

17. The storm door of claim 6, wherein the first flexible members comprise compressible flexible tubing.

18. The storm door of claim 6, wherein the first flexible members are positioned between the jamb liner connecting members and the sides.

19. The storm door of claim 6, wherein the first flexible members are sized to form an interference fit between the jamb liners and the sides when compressed for insertion between the jamb liners and the sides.

20. The storm door of claim 6, wherein the jamb liners are fixed in position with respect to the sides so that there is substantially no movement in any direction.

21. A storm door comprising:

a) a frame having first and second side rails, a top rail extending between and interconnecting the side rails at their upper ends and a bottom rail extending between and interconnecting the side rails at their lower ends;

b) a first jamb liner operatively connected to the first side rail and forming a vertically extending first hollow chamber between the first side rail and the first jamb liner;

c) a second jamb liner operatively connected to the second side rail and forming a vertically extending second hollow chamber between the second side rail and the second jamb liner;

d) the jamb liners forming first, second and third positions;

e) a screen extending between the first position;

f) a first slidable window sash positioned between the jamb liners at the second position;

g) a second slidable window sash positioned between the jamb liners at the third position;

h) first and second sach weight balancing assemblies connected to the first and second side rails respectively and each connected to the first slidable window sash, said first and second sash weight balancing assemblies located in the first and second hollow chambers respectively, for counterbalancing the first slidable sash;

i) third and fourth sash weight balancing assemblies connected to the first and second side rails respectively and each connected to the second slidable window sash, the third and fourth sash weight balancing assemblies located in the first and second hollow chambers for counterbalancing the second slidable sash; and j) first and second flexible members compressibly retained between the first and second jamb liners and the first and second sides, respectively, so as to secure the first and second flexible members with an interference fit, whereby the first and second jamb liners are firmly held in place by the first and second flexible members, respectively.

22. The storm door of claim 21, wherein the screen is adjacent both first and second sashes when the sashes are in a closed position.

23. The storm door of claim 21, wherein the third and fourth sash weight balancing assemblies are at an angle to the first and second sash weight balancing assemblies, thereby allowing for a narrower door.

24. A storm door comprising:

a) a frame having first and second sides, said sides operatively connected at their top ends by a top and at their bottom ends by a bottom;

b) said sides each having a wall to form an opening;

c) first and second jamb liners positioned in the openings of the first and second sides respectively to form hollow chambers between the sides and liners;

d) said jamb liners having at least two points of contact with the sides to limit movement of the liners; and e) first and second flexible members positioned between the first and second sides and the first and second jamb liners, respectively, the first and second flexible members configured as compressible members retained between the liners and the sides and secured with an interference fit, whereby the jamb liners are firmly held in place by the flexible members.

25. The storm door of claim 24, wherein the first side is a first side rail, the second side is a second side rail, the top is a top rail and the bottom is a bottom rail.

26. The storm door of claim 24, wherein each flexible member is a plurality of discrete flexible members.

* * * * *